US005213253A

United States Patent [19]

Fantoni et al.

[11] Patent Number: 5,213,253

[45] Date of Patent: May 25, 1993

[54] POCKET-CONTAINER, IN PARTICULAR FOR TAKING DRINKS OR OTHER FOOD

[76] Inventors: Gianluca Fantoni, via Carinelli n. 4/d; Davide Gottardi, via dei Biancospini n. 5, both of Verona, Italy

[21] Appl. No.: 913,656

[22] Filed: Jul. 16, 1992

[30] Foreign Application Priority Data

Dec. 18, 1991 [IT] Italy ..... VR91A000109

[51] Int. Cl.[5] ..... B65D 5/36; B65D 5/40; B65D 5/56

[52] U.S. Cl. ..... 229/1.5 B; 220/462; 229/117

[58] Field of Search ..... 229/1.5 B, 117, 117.01; 220/403, 408, 410, 461, 462

[56] References Cited

U.S. PATENT DOCUMENTS

| | | | |
|---|---|---|---|
| 3,373,917 | 3/1968 | Cox | 220/461 |
| 3,517,875 | 6/1970 | Wakefield | 229/117 |
| 3,567,105 | 3/1971 | Farlin | 220/462 |
| 4,266,716 | 5/1981 | Austin | 229/117 |
| 4,280,676 | 7/1981 | Betts | 220/403 |
| 4,284,205 | 8/1981 | Hirata | 220/461 |
| 4,391,366 | 7/1983 | Hirata | 229/1.5 B |
| 4,428,499 | 1/1984 | Nauheimer | 220/410 |
| 4,428,500 | 1/1984 | Kohler | 229/1.5 B |
| 4,792,086 | 12/1988 | Chen | 229/117 |
| 4,854,474 | 8/1989 | Murray et al. | 229/1.5 B |

*Primary Examiner*—Gary E. Elkins
*Attorney, Agent, or Firm*—Browdy and Neimark

[57] ABSTRACT

A pocket-container consists of a "self-shaping" folding box (1) made of paperboard or plastic material. The box (1) has an open top (2), side walls (3) and a closed base (4) formed with die-cut sectors (5) mutually overlapping and engaging into one another. A sheet (6) of preferably elastic, waterproof material is fastened to the box side walls (3). When folded before use, the box (1) is in the form of a pack of very reduced thickness (S) so that it can be easily kept in a pocket. The container thus made is of the disposable type.

7 Claims, 3 Drawing Sheets

POCKET-CONTAINER, IN PARTICULAR FOR TAKING DRINKS OR OTHER FOOD

BACKGROUND OF THE INVENTION

1. Field of the Invention

The present invention pertains to a pocket-container, to be used in particular for holding drinks or other food. More specifically it concerns a container in the form of a cup, a glass, etc. preferably made of paperboard or biodegradable plastic material which before use is folded in the form of a thin (and therefore pocket-size) pack and at the moment of use takes the shape of a disposable container.

This pocket-container may be used to satisfy any need and in particular may be intended for taking drinks, ice-creams, creams or other food, both in a solid and liquid state, whenever a traditional container is not available or, for any reason, for example of economical or sanitary nature, the use of a traditional container is not desirable.

2. Prior Art

Presently, in the field of drink containers of the disposable type, glasses or cups are known that are made of paperboard or plastic material which however are not pocket-size.

Pocket-size glasses are also currently available. They are made of plastic material and consist of several concentric rings of truncated conical form fitted one into the other telescopically. At the end of the last ring there is a box-shaped base inside which all rings upon being axially compressed can be housed when the glass is not used. Then a lid is screwed to the box-shaped base, which enables the glass to be enclosed in the box-shaped casing.

It is known that these pocket-glasses have several drawbacks: they are relatively expensive and therefore cannot be considered as disposable items; they are not very hygienic and once used cannot be easily washed due to interstices present between the rings; rings often tend to fall downwardly which brings about the reduction in height of the glass and the escape of the liquid contained therein; the casing has relatively big sizes and consequently the glass cannot be put for example in a breast pocket or in a purse.

SUMMARY OF THE INVENTION

The main object of the present invention is to overcome the above drawbacks relating to containers of known type by providing a container, in particular for drinks or other food, which is really pocket-size, very cheap and therefore of the disposable type and consequently quite hygienic and also adapted to be readly converted from the pocket-format to a format suitable for use.

The foregoing and further objects are attained by the pocket-container of the invention consisting of a "self-shaping" folding box exhibiting an open top, side walls and a closed base formed with die-cast sectors that mutually overlap and engage into each other, a sheet of waterproof material being associated with said closed base and fastened to said side walls, said box when folded before use being in the form of a pack of small thickness.

In accordance with another feature of the invention the waterproof material is an elastic material, said elastic material, by effect of the pressure exerted on the box walls, being capable of causing the box to automatically take the desired shape by itself.

BRIEF DESCRIPTION OF THE DRAWINGS

Further features and advantages of the present invention will become more apparent from the detailed description of some preferred embodiments thereof, given hereinafter by way of non-limiting example with reference to the accompanying drawings, in which.

DESCRIPTION OF THE PREFERRED EMBODIMENTS

Figure 1:
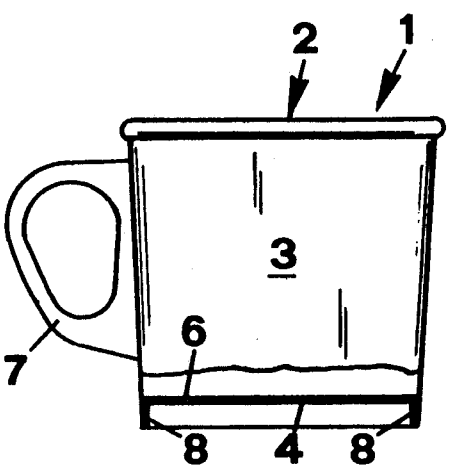
FIG. 1 is a partly sectional side view of a container in accordance with the invention in the form of a cup, involving the adoption a first positioning pattern of the waterproof sheet.

Referring to the drawings, the container of the invention is formed from a "self-shaping" folding box 1 preferably made of paper, paperboard or biodegradable plastic material. It has an open top 2, side walls 3 and a closed lower base 4 formed with die-cut sectors 5 mutually overlapping and engaging into each other.

Sectors 5 are not described in detail as known per se, in that they are already used to form packaging cases for liquor bottles or other items, which cases get mounted automatically.

Associated with the closed base 4 is a sheet 6 of waterproof material fastened (by gluing, heat seal or the like) to the side walls 3 of box 1. This sheet 6 has the function of preventing the liquid contained in the box 1 from escaping through the slits existing between sectors 5.

Figure 9B:
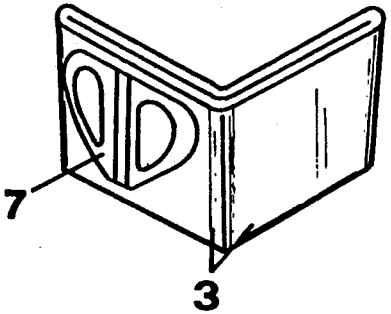
FIGS. 9*a*, 9*b* and 9*c* show the container of the invention provided with handles, in a pack-wise folded, partly open, and completely raised positions, respectively.
Figure 9C:
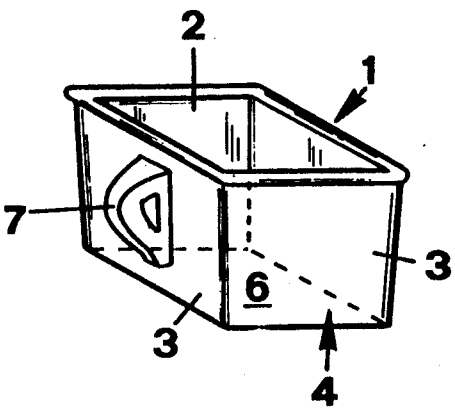
Figure 9A:
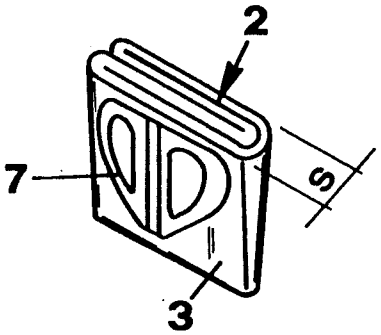

FIGS. 1 to 9*c* show the inventive container in the form of a cup provided with a handle 7, which can be unfolded from a flat position (FIG. 9*a*) to a use position (FIG. 9*c*).

Figure 2:
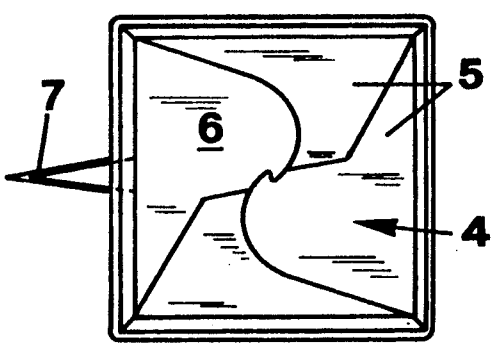
FIG. 2 is a top view of the container shown in FIG. 1.

FIGS. 1 and 2 show a first positioning pattern of the waterproof sheet 6. In this case the closed base 4 has downwardly bent perimetrical edges 8 and walls 3 extend beyond the closed base 4 as far as the end of edges 8. Fastening of sheet 6 takes place in the space included between edges 8 and walls 3, said sheet being located inside the box 1 and immediately above the closed base 4.

Figure 3:
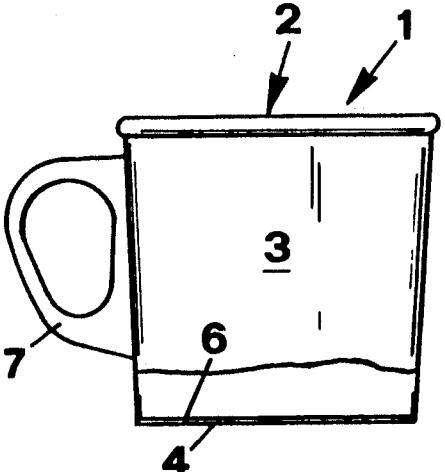
FIG. 3 is a partly sectional side view of a container according to the invention in the form of a cup, involving the adoption of a second positioning pattern of the waterproof sheet.
Figure 4:
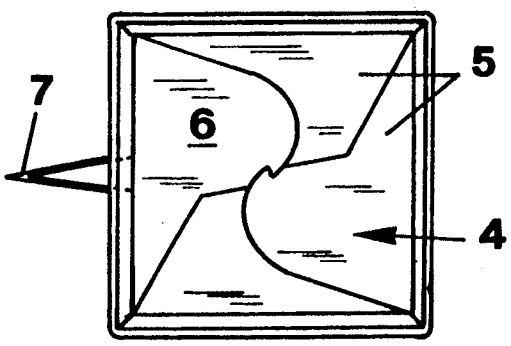
FIG. 4 is a top view of the container shown in FIG. 3.
Figure 11:
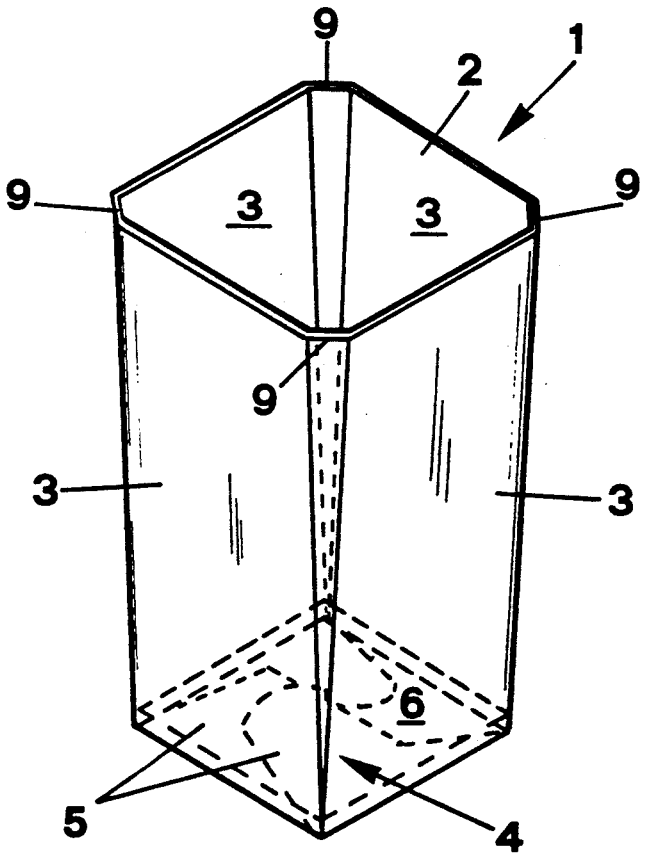
FIG. 11 is an axonometric view of the container in accordance with the invention in the form of a glass the upper rim of the open end of which has rounded-off corners.

FIGS. 3, 4 and 11 show a second positioning pattern of the waterproof sheet 6. In this case the waterproof sheet 6 is merely located over the closed base 4 and therefore at the inside of box 1.

Figure 5:
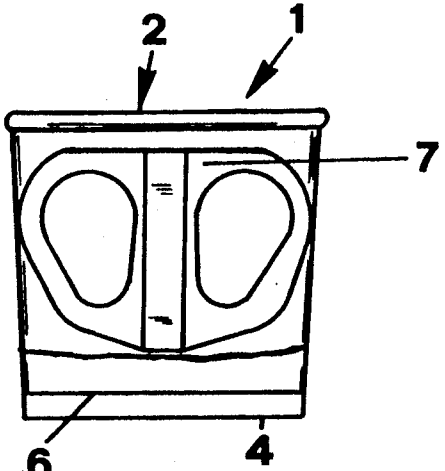
FIG. 5 is a partly sectional side view of a container in accordance with the invention in the form of a cup, involving the adoption of a third positioning pattern of the waterproof sheet.
Figure 6:
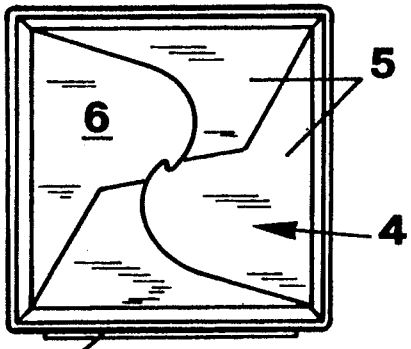
FIG. 6 is a top view of the container shown in FIG. 5.

FIGS. 5 and 6 show a third positioning pattern of the waterproof sheet 6. In this case the waterproof sheet 6 is disposed within the box 1, still above the closed base 4 but spaced apart therefrom.

Figure 7:
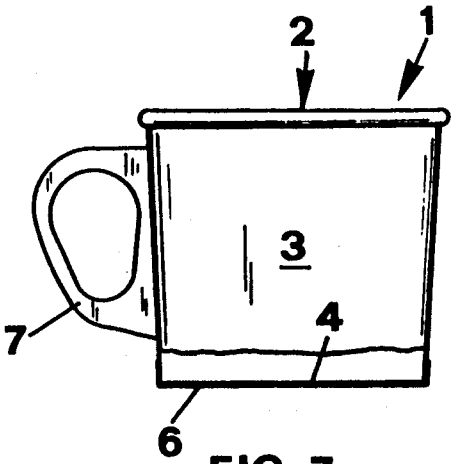
FIG. 7 is a partly sectional side view of the container of the invention in the form of a cup, involving the adoption of a fourth positioning pattern of the waterproof sheet.
Figure 8:
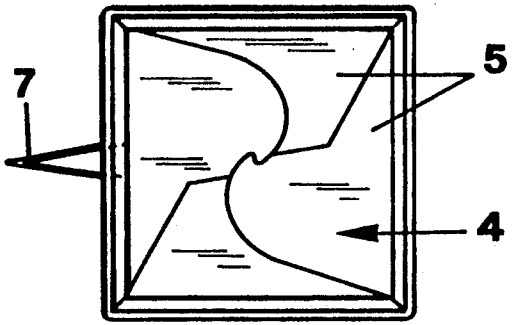
FIG. 8 is a top view of the container shown in FIG. 7.

FIGS. 7 and 8 show a fourth positioning pattern of the waterproof sheet 6. The waterproof sheet 6 is herein disposed at the outside of box 1 under the lower surface of the closed base 4.

Figure 10:
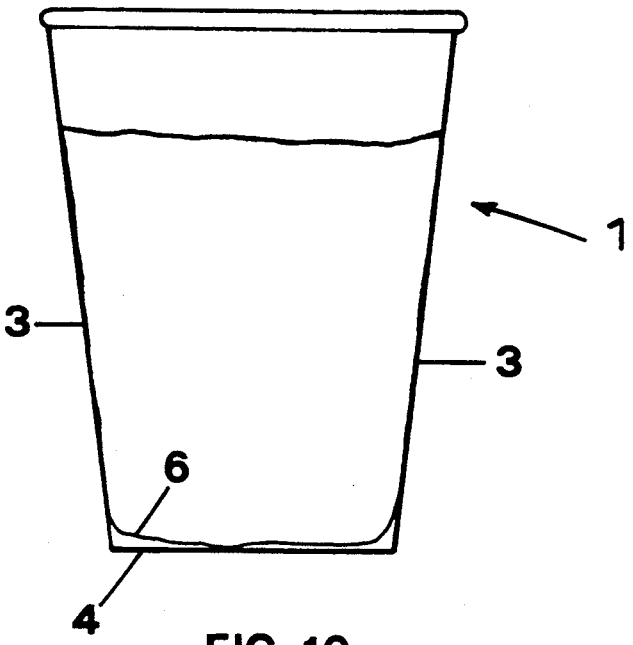
FIG. 10 is a partly sectional view of the container of the invention in the form of a glass, according to a fifth positioning pattern of the waterproof sheet.

FIG. 10 shows a fifth positioning pattern of the waterproof sheet 6, this sheet being in this case formed as a bag fitted inside the box 1 shaped as a glass of quadrangular section.

The glass shown in FIG. 11 instead has the open upper end 2 provided with a polygonal perimetric rim exhibiting rounded-off corners 9 so as to help in taking the drink contained therein.

In all cases shown in the accompanying drawings (apart from the one shown in FIG. 10) the waterproof material forming the sheet 6 can advantageously consist of an elastic material (for example biodegradable natural rubber latex). This elastic material, by effect of the pressure exerted on the box walls 3, is capable of causing the box 1 to automatically take the desired shape.

In fact said box 1 before use is folded upon itself (see FIG. 9*a*) and can be advantageously contained in a paper or plastic sheath (not shown) sealed for sanitary reasons.

When the sheath is opened and the box 1 is taken out, said box is first manually unfolded in the form shown in FIG. 9*b*, then it automatically takes the shape shown in FIG. 9*c*.

It should be noted that when the box 1 is packwise folded (FIG. 9*a*) it has a small (some millimeter) thickness S so that it is really pocket-size (it can be for example held in a breast pocket or in a purse in the same manner as traditional paper handkerchiefs).

The container of the invention can be made of any material; at all events a biodegradable material (that is box 1 of paper or paperboard and sheet 6 of natural rubber latex) is preferred, as this container, being very cheap, is to be considered of the disposable type.

Said containers can be supplied to a user either individually (contained in a protection sheath) or in the form of a continuous strip (contained in individual protection sheaths sealed to one another).

In addition, the container in the form of a cup or a glass may be also used in combination with soluble inside foodstuffs (sugar for example) or freeze-dried substances (such as coffee), which could be already put in the box 1 forming the container. Thus, at the moment of use it will be sufficient to add water thereby obtaining the desired drink in a cup or glass.

In addition, also external items (for example a teaspoon, a small shovel, a sugar sachet, a cleansing towel, etc.) could be combined with the container in question. In this way said container will find an optimal application on board of airplanes, ships, trains, in hospitals, canteens, schools, etc.

The invention attains the intended purposes.

Obviously the invention is not considered limited to the examples choses for purposes of illustration and includes all changes and modifications which do not constitute a departure from the true scope of this invention as claimed in the following claims.

What is claimed is:

1. A pocket-container for holding drinks or other food, said container comprising a shaped folding box (1) having an open top (2), side walls (3) and a closed base (4), said closed base being formed with die-cast sectors (5) that mutually overlap and engage into each other, a sheet (6) of waterproof material being associated with said closed base (4), said waterproof sheet (6) being an elastic resilient material located inside said box (1) over said closed base (4) and fastened to said side walls (3), said box (1) when folded before use being in a form of a package of small thickness (S).

2. The pocket-container as claimed in claim 1, wherein said waterproof sheet (6) is formed with a bag fitted inside said box (1).

3. The pocket-container as claimed in claim 1, wherein said open top (2) has a polygonal perimetric rim exhibiting rounded-off corners (9).

4. A pocket-container for holding drinks or other food, said container comprising a shaped folding box (1) having an open top (2), side walls (3) and a closed base (4), said closed base being formed with die-cast sectors (5) that mutually overlap and engage into each other, a sheet (6) of waterproof material being associated with said closed base (4), and fastened to said side walls (3), said box (1) when folded before use being in a form of a package of small thickness (S), said waterproof material is an elastic resilient material, wherein said box when folded before use automatically takes a desired final shape by effect of a resilient pressure exerted by said elastic resilient material on said side walls.

5. A pocket-container for holding drinks or other food, said container comprising a shaped folding box (1) having an open top (2), side walls (3) and a closed base (4), said closed base being formed with die-cast sectors (5) that mutually overlap and engage into each other, a sheet (6) of waterproof material being associated with said closed base (4), and fastened to said side walls (3), said box (1) when folded before use being in a form of a package of small thickness (S), said waterproof material is an elastic resilient material, and said waterproof sheet (6) is located inside said box (1), above said closed base (4) but spaced apart therefrom, wherein said box when folded before use automatically takes a desired final shape by effect of a resilient pressure exerted by said elastic resilient material on said side walls.

6. A pocket-container for holding drinks or other food, said container comprising a shaped folding box (1) having an open top (2), side walls (3) and a closed base (4), said closed base being formed with die-cast sectors (5) that mutually overlap and engage into each other, a sheet (6) of waterproof material being associated with said closed base (4), and fastened to said side walls (3), said box (1) when folded before use being in a form of a package of small thickness (S), said waterproof material is an elastic resilient material, and said waterproof sheet (6) is located outside of said box (1) under a lower surface of said closed base (4), wherein said box when folded before use automatically takes a desired final shape by effect of a resilient pressure exerted by said elastic resilient material on said side walls.

7. A pocket-container for holding drinks or other food, said container comprising a shaped folding box (1) having an open top (2), side walls (3) and a closed base (4), said closed base being formed with die-cast sectors (5) that mutually overlap and engage into each other, a sheet (6) of waterproof material being associated with said closed base (4), and fastened to said side walls (3), said box (1) when folded before use being in a form of a package of small thickness (S), said closed base (4) has downwardly bent parametric edges (8) and said walls (3) extend beyond said closed base (4) as far as an end of said bent parametric edges (8), said sheet (6) of waterproof material being fastened in a space included between said bent parametric edges (8) and walls (3) and located inside said box (1) and immediately above said closed base (4).

* * * * *